US006588772B2

(12) United States Patent
Smith et al.

(10) Patent No.: US 6,588,772 B2
(45) Date of Patent: Jul. 8, 2003

(54) SINTERED SHEET PLASTIC MATERIAL AND GLIDING BOARD BASE MATERIAL

(75) Inventors: R. Paul Smith, Burlington, VT (US); G. Scott Barbieri, Middlebury, VT (US)

(73) Assignee: The Burton Corporation, Burlington, VT (US)

( * ) Notice: Subject to any disclaimer, the term of this patent is extended or adjusted under 35 U.S.C. 154(b) by 6 days.

(21) Appl. No.: 09/750,437

(22) Filed: Dec. 28, 2000

(65) Prior Publication Data

US 2002/0084603 A1 Jul. 4, 2002

(51) Int. Cl.[7] ..... B62M 29/00; A63C 5/00; B28B 1/00; D06N 7/04

(52) U.S. Cl. ..... 280/14.21; 280/601; 280/610; 280/87.041; 156/62.2; 264/673; 441/68; 441/74; 428/141

(58) Field of Search ..... 280/601, 608, 280/609, 610, 14.21, 14.22, 18, 18.1, 87.041; 441/68, 74, 76, 79, 65; 428/105, 143, 147, 141, 212, 195, 34.4, 34.5; 264/673, 122, 125, 113; 75/383; 521/919; 156/296, 62.6, 62.2

(56) References Cited

U.S. PATENT DOCUMENTS

| | | | |
|---|---|---|---|
| 2,422,979 | A | 6/1947 | Pecker |
| 2,434,573 | A | 1/1948 | Mann et al. |
| 2,697,254 | A | 12/1954 | Gordon |
| 2,786,233 | A | 3/1957 | Merrill |
| 3,133,848 | A | 5/1964 | Proctor et al. |
| 3,194,856 | A | 7/1965 | Palmer |
| 3,272,522 | A | 9/1966 | Kennedy, III |
| 3,399,425 | A | 9/1968 | Lemelson |
| 3,408,086 | A | 10/1968 | Bennett |
| 3,470,286 | A | 9/1969 | Weber |

(List continued on next page.)

FOREIGN PATENT DOCUMENTS

| | | | | |
|---|---|---|---|---|
| AT | 332273 | * | 6/1994 | ..... 428/474.4 |
| CH | 643 463 | A5 | 6/1984 | |
| CH | 671 707 | A5 | 9/1989 | |
| DE | 37 44 727 | A1 | 2/1989 | |
| DE | 41 05 285 | A1 | 8/1992 | |

(List continued on next page.)

OTHER PUBLICATIONS

Burton Snowboards Hardgoods Dealer Catalog 2001, 2 pages, fusion board with die cut base and wear resistant edge strips.

*Primary Examiner*—Brian L. Johnson
*Assistant Examiner*—G B Klebe
(74) *Attorney, Agent, or Firm*—Wolf, Greenfield & Sacks, P.C.

(57) ABSTRACT

A method for forming a sheet material suitable for use in manufacturing gliding board bases includes placing a first group of materials including plastic particles on a continuously moving surface in a first pattern, and placing a second group of materials including plastic particles on the continuously moving surface in a second pattern. Heat and pressure are applied to sinter the plastic particles together to form the sheet material having a first area with a first set of characteristics formed mainly of particles from the first group adjacent a second area with a second set of characteristics different from the first set of characteristics formed mainly from particles from the second group. The first and second sets of characteristics may include only one characteristic, such as color, hardness, wear-resistance, etc., or a plurality of different characteristics. A sheet material and gliding board having a base made with such sheet material also include first and second areas having at least one different property.

22 Claims, 2 Drawing Sheets

U.S. PATENT DOCUMENTS

| | | | | | |
|---|---|---|---|---|---|
| 3,607,999 | A | | 9/1971 | Corbett et al. | |
| 3,635,483 | A | | 1/1972 | Barriball et al. | |
| 3,637,226 | A | | 1/1972 | Simon | |
| 3,682,578 | A | | 8/1972 | Lachiche | |
| 3,835,212 | A | | 9/1974 | Piacente | |
| 3,852,151 | A | | 12/1974 | Knapp | |
| 3,897,074 | A | | 7/1975 | Tiitola | |
| 3,902,732 | A | | 9/1975 | Fosha, Jr. et al. | |
| 3,918,728 | A | | 11/1975 | Stugger et al. | |
| 3,992,501 | A | * | 11/1976 | Tatzel et al. | 264/126 |
| 4,057,606 | A | | 11/1977 | Kobayashi et al. | |
| 4,076,567 | A | * | 2/1978 | Yoshikawa et al. | 156/219 |
| 4,077,652 | A | | 3/1978 | McCaskey, Jr. et al. | |
| 4,154,893 | A | | 5/1979 | Goldman | |
| 4,155,968 | A | | 5/1979 | Yamamoto et al. | |
| 4,162,880 | A | | 7/1979 | Cobbs, Jr. et al. | |
| 4,216,179 | A | | 8/1980 | Lamberts et al. | |
| 4,272,577 | A | | 6/1981 | Lyng | |
| 4,321,222 | A | | 3/1982 | Mosiener, deceased et al. | |
| 4,340,347 | A | | 7/1982 | Robertson | |
| 4,382,108 | A | | 5/1983 | Carroll et al. | |
| 4,402,889 | A | | 9/1983 | Bonis | |
| 4,525,159 | A | | 6/1985 | Filderman et al. | |
| 4,597,922 | A | | 7/1986 | Durbin | |
| 4,635,954 | A | | 1/1987 | Arnsteiner | |
| 4,647,063 | A | | 3/1987 | Piringer et al. | |
| 4,705,815 | A | | 11/1987 | Longeray et al. | |
| 4,706,985 | A | | 11/1987 | Meatto | |
| 4,756,858 | A | | 7/1988 | Reifehauser et al. | |
| 4,810,445 | A | | 3/1989 | Lamb, Sr. et al. | |
| 4,813,699 | A | | 3/1989 | Burger et al. | |
| 4,844,500 | A | | 7/1989 | Fischer | |
| 4,879,081 | A | | 11/1989 | Keep | |
| 4,902,548 | A | | 2/1990 | Cholat-Serpoud et al. | |
| 4,923,658 | A | | 5/1990 | Hover et al. | |
| 4,933,127 | A | | 6/1990 | Guiguet | |
| 4,968,463 | A | | 11/1990 | Levasseur | |
| 4,968,726 | A | | 11/1990 | Thorsrud | |
| 5,069,976 | A | * | 12/1991 | Vuachet et al. | 428/474.4 |
| 5,085,812 | A | | 2/1992 | Ahrweiler et al. | |
| 5,114,331 | A | | 5/1992 | Umehara et al. | |
| 5,128,200 | A | | 7/1992 | Colley et al. | |
| 5,167,889 | A | | 12/1992 | Alvarez et al. | |
| 5,310,205 | A | | 5/1994 | Piegay et al. | |
| 5,468,543 | A | * | 11/1995 | Schamesberger | 428/220 |
| 5,537,718 | A | | 7/1996 | Nagatsuka et al. | |
| 5,580,078 | A | | 12/1996 | Vance | |
| 5,589,260 | A | | 12/1996 | Ben Zvi et al. | |
| 5,725,237 | A | | 3/1998 | Krafft et al. | |
| 5,736,084 | A | * | 4/1998 | Uchida et al. | 264/112 |
| 5,769,445 | A | | 6/1998 | Morrow | |
| 5,782,482 | A | | 7/1998 | Andrus et al. | |
| 5,788,259 | A | | 8/1998 | Emig | |
| 5,855,389 | A | | 1/1999 | Andrus et al. | |
| 5,871,224 | A | | 2/1999 | Vance | |
| 5,876,056 | A | | 3/1999 | Karlsen | |
| 6,048,426 | A | | 4/2000 | Pratt | |
| 6,059,306 | A | | 5/2000 | Metrot et al. | |
| 6,059,308 | A | | 5/2000 | Baudin et al. | |
| 6,073,954 | A | | 6/2000 | Guiguet et al. | |
| 6,073,956 | A | | 6/2000 | Zemke et al. | |
| 6,082,747 | A | | 7/2000 | Parmentier | |
| 6,105,991 | A | | 8/2000 | Dodge et al. | |

FOREIGN PATENT DOCUMENTS

| | | | | | |
|---|---|---|---|---|---|
| DE | 41 13 056 | A1 | | 10/1992 | |
| EP | 0 118 079 | A1 | | 9/1984 | |
| EP | 0228654 | A2 | | 7/1987 | |
| EP | 0 444 330 | B1 | | 9/1991 | |
| EP | 0 447 356 | B1 | | 9/1991 | |
| FR | 2 564 737 | A3 | | 11/1985 | |
| FR | 2 568 479 | A1 | | 2/1986 | |
| GB | 1238881 | | | 7/1971 | |
| JP | 359101335 | A | * | 6/1984 | 264/122 |

* cited by examiner

SINTERED SHEET PLASTIC MATERIAL AND GLIDING BOARD BASE MATERIAL

FIELD OF THE INVENTION

This invention relates to sintered plastic sheet materials.

BACKGROUND OF THE INVENTION

Gliding board bases, such as ski and snowboard soles, are typically made of a thermoplastic material, such as polyethylene, and have been made with different areas of the sole having different properties. For example, U.S. Pat. No. 5,310,205 discloses a ski sole having a pair of relatively high hardness strips of polyethylene located near the ski edges in a runner zone and a softer polyethylene material located elsewhere on the ski sole. The patent also indicates that the sole can be obtained by sintering, but states that greater hardness can be obtained by extrusion.

Swiss Patent CH 643463 discloses a block sintering process for forming ski bases having anisotropic properties across the base. The patent describes molding three layers of pulverulent base material in a cylindrical composite compression mold. The base material is sintered under pressure and a continuous strip is skived, or peeled, off from the sintered body. The patent describes that the skived strip may have different areas having different properties depending on the materials used to form the layers and how the strip is skived from the sintered block.

SUMMARY OF THE INVENTION

In one embodiment incorporating aspects of the invention, a method for forming a unitary sheet material suitable for use in manufacturing gliding board bases includes placing a first group of materials including plastic particles on a surface in a first pattern, and placing a second group of materials including plastic particles on the surface in a second pattern. Heat and pressure are applied to sinter the plastic particles together to form the unitary sheet material having a first area with a first set of characteristics formed mainly of particles from the first group adjacent a second area with a second set of characteristics different from the first set of characteristics formed mainly from particles from the second group. The first and second sets of characteristics may include only one characteristic, such as color, hardness, wear-resistance, etc., or a plurality of different characteristics.

In another embodiment, a sheet material suitable for forming gliding board bases includes a first area with a first set of characteristics formed mainly from a first group of materials including plastic particles, and a second area with a second set of characteristics different from the first set of characteristics formed mainly from a second group of materials including plastic particles. The plastic particles in the first and second groups of materials are sintered together by a continuous sintering process to form the sheet material.

These and other aspects of the invention will be apparent from the following description and appended claims.

BRIEF DESCRIPTION OF THE DRAWINGS

Illustrative embodiments are described in connection with the following drawings, in which numerals reference like elements, and wherein.

DETAILED DESCRIPTION

Figure 1:
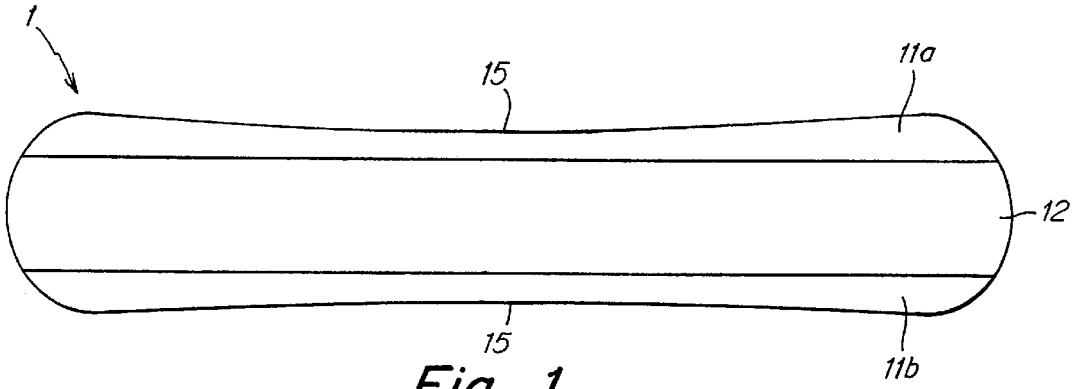
FIG. 1 is a top view of a snowboard base in a first illustrative embodiment.

An illustrative embodiment incorporating aspects of the invention provides a continuously sintered sheet material that may be used for a gliding board base, such as a ski or snowboard sole. In this illustrative embodiment, the sheet material may be formed, at least in part, from plastic particles that are sintered into a sheet form using a continuous belt sintering process. The sheet material may include a first area having a first set of properties that is made mainly from a first group of materials, and a second area having a second set of properties that is made mainly from a second group of materials. Since the gliding board base may be made using a continuous belt sintering process, base material having different areas with different properties may be made rapidly and at relatively low cost. This is in contrast to other sintering techniques, such as block-type sintering followed by skiving processes. Moreover, the size and/or shape of the different areas as well as the interface between areas can be more precisely controlled in accordance with the invention. For example, different groups of materials may be arranged in a desired pattern and then sintered to form the base material having a pattern that closely matches that of the material pattern. In contrast, typical block sintering and skiving processes do not allow for precise control of the size and/or shape of different areas in the skived base material because these features depend upon how different layers in the block are arranged and sintered, as well as the position of the skiving blade relative to the layers of different material in the block as the base material is peeled from the block.

In one illustrative embodiment, a sheet material suitable for gliding board bases can be made by placing a first group of materials including plastic particles on a surface in a first pattern and placing a second group of materials including plastic particles on the surface in a second pattern. Heat and pressure are applied to the particles to sinter the particles together and form a unitary sheet material. The surface can be a moving belt onto which one or more particle feeding devices place the first and second groups of particles on the moving belt. For example, plastic granules may be deposited on the belt in approximately parallel strips. The particles are then sintered to form the sheet material which may have areas that closely correspond to the parallel strip pattern in which the granules were placed on the belt. Sintering may involve heating and squeezing the particles between two opposed, and moving, belts that are arranged at an angle relative to each other so that progressively higher pressure is applied to the particles as they move with the converging belts.

A variety of different characteristics may be exhibited by the different areas in the sheet material. For example, the areas may vary in wear resistance, hardness, color, lubricity, density, molecular orientation, and so on. Because the size and/or shape of the different areas may be controlled based on how particles are placed on a surface, the different areas can have any suitable size or shape and form any design for either functional or aesthetic purposes. For example, the different areas of the sheet material may form text, geometric shapes, graphical designs, or other patterns.

FIG. 1 shows a plan view of the bottom, or sole, of a snowboard 1 in an illustrative embodiment in accordance with the invention. In this illustrative embodiment, the sole includes two areas 11*a* and 11*b* that extend approximately the length of the snowboard 1 near the edges 15. The sole also includes a central area 12 that runs almost the entire length of the snowboard 1. In this embodiment, the areas 11*a* and 11*b* have different set of characteristics than the central area 12, i.e., the areas 11*a* and 11*b* have at least one characteristic that is different that the central area 12. (For clarity and ease of understanding, the numerals 11 and 12 are used herein to refer to areas that have different sets of characteristics from each other. In this description, areas having the same number, e.g., 11, have the same or similar characteristics. Thus, the areas 11*a* and 11*b* have the same or similar characteristics. As is discussed more fully below, it should be understood, however, that the invention is not limited to the few illustrative embodiments provided herein or the numbering scheme used to identify the areas.) For example, the areas 11*a* and 11*b* may have a higher wear resistance than the central area 12. Thus, the areas 11*a* and 11*b* may be more resistant to gouging, scratching or other damage caused by high frictional and other forces that are more present near the edges 15 of the snowboard 1 as compared to areas nearer the center of the sole.

In this embodiment, the areas 11*a* and 11*b* and the central area 12 may exhibit other characteristics, either in addition to, or in place of the relative wear resistant properties. For example, the areas 11*a* and 11*b* may have different colors, wax content, molecular weights, chemical compositions, molecular orientations, or other properties as compared to the central area 12. Moreover, although the areas 11*a*, 11*b* and 12 are shown in FIG. 1 as forming three strips along the length of the snowboard 1, the areas 11*a*, 11*b* and 12 may form any shape or pattern on the snowboard sole. For example, the areas 11*a*, 11*b* and 12 may be arranged to form any graphical design, including text, graphical shapes, and so on. The junction between the areas 11*a*, 11*b* and 12 may be formed by a sharp line or division between the areas 11*a*, 11*b* and 12, or the junction may be formed as a more gradual transition. The transition between the areas 11*a*, 11*b* and 12 can be controlled, at least in part, by the degree to which materials used to form the areas are mixed before or at the time of sintering. For example, materials used to form the areas 11*a*, 11*b* and 12 may be mixed to some extent in a transition area between the areas 11*a*, 11*b* and 12.

Figure 2:
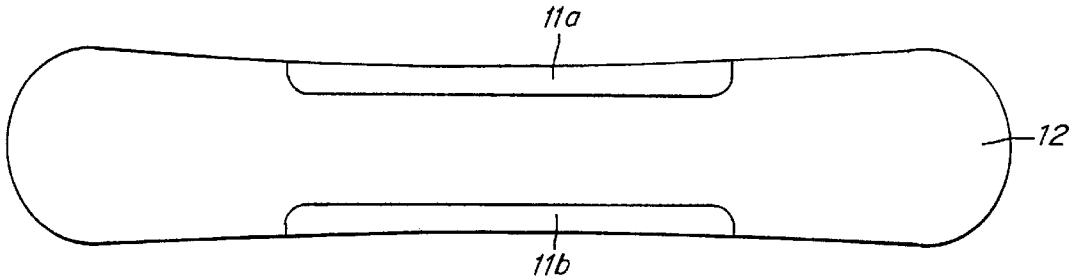
FIG. 2 is a plan view of a snowboard base in a second illustrative embodiment.

FIG. 2 shows a bottom view of another illustrative embodiment of a snowboard sole. In this embodiment, the edge areas 11*a* and 11*b* form two strips that extend along the edges 15 of the snowboard 1, but unlike the embodiment in FIG. 1, the strip-like portions of the areas 11*a* and 11*b* only extend along a part of the length of the snowboard 1. The central area 12 forms the remaining portion of the snowboard sole. Such an arrangement may be suitable when higher wear resistance is needed only along a portion of the snowboard sole, for example.

Figure 3:
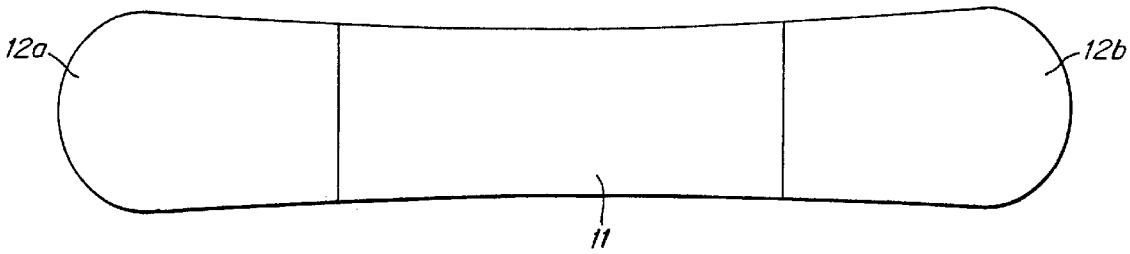
FIG. 3 is a plan view of a snowboard base in a third illustrative embodiment.

FIG. 3 shows another embodiment for a snowboard sole in which a mid-region area 11 covers a mid-region of the sole, while two other areas 12*a* and 12*b* cover tip and tail regions near the ends of the sole. As discussed above, it should be understood that the illustrative embodiments shown in FIGS. 1–3 are not intended to limit the size, shape or other features of the areas 11 and 12. Moreover, three or more different areas each having one or more different characteristics may be used in the snowboard sole. For example, the illustrative embodiment shown in FIG. 3 may have a first area having a first set of characteristics at a tip region of the sole, a second area having a second set of characteristics near a mid-region of the sole, and a third area having a third set of characteristics near a tail area of the sole.

Figure 4:
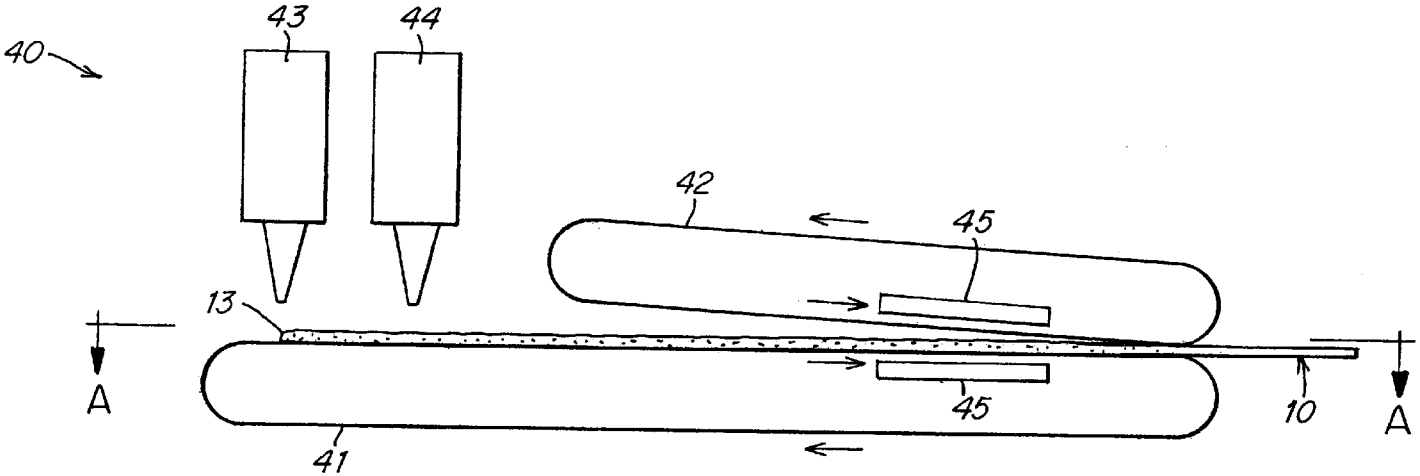
FIG. 4 is a schematic side view of an illustrative embodiment of a continuous belt sintering apparatus in accordance with the invention.

FIG. 4 is a schematic view of a continuous sheet material forming apparatus in an illustrative embodiment in accordance with the invention. In this embodiment, two particle feed devices 43 and 44 deposit particles 13 on a belt 41 in desired patterns. The particles are conveyed from left to right in FIG. 4 so that the particles 13 are heated and pressed between the lower belt 41 and an upper belt 42. The resulting sintered sheet material 10 emerges downstream of the belts 41 and 42 and can be used to form snowboard or other gliding board bases. That is, the sheet material 10 may have a thickness that is suitable for incorporation into a gliding board base without alteration of the thickness (except for any grinding or other processing of the gliding board base that may be performed in manufacture to create a desired bottom surface for the board and does not substantially alter the thickness of the base material).

The sheet material 10 is made continuously by the apparatus shown in FIG. 4. That is, particles 13 on the belt 41 are continuously sintered, e.g., from one end of the sheet material 10 to the other, to form the sheet material 10, rather than sintered more or less simultaneously as in a block sintering method. However, the term "continuously" is not intended to suggest that sheet material 10 for more than one gliding base is made in a continuous sheet. Although the apparatus shown in FIG. 4 may be used to continuously make very long lengths of sheet material 10 suitable for forming multiple gliding board bases, the apparatus may continuously form individual sheets of material that are each used to form one, two or more gliding board bases.

Sheet material for gliding board bases having uniform properties throughout has been previously made by continuous sintering processes. Thus, although the details regarding operation of a continuous sintering process can vary and are well known in the art, in a preferred process, the particle feed devices 43 and 44 deposit materials including plastic, e.g., polyethylene, granules having an approximate diameter of 0.15 mm when measured per ASTM D-50. The depth to which the particles 13 are deposited on the belt 41 depends upon the thickness of the final sheet material 10. For example, the particles 13 are deposited to a depth of approximately 6 mm on the belt 41 to form a sheet material 10 having a final thickness of approximately 1.2 mm. Similarly, the particles 13 may be deposited in any width on the belt 41, such as a total width of approximately 32 cm. The particles 13 are heated by heating the belts 41 and 42, e.g., with electrical resistance heaters 45 positioned near the belts 41 and 42 on a side opposite the particles 13. The particles are heated (e.g., to a temperature of approximately 250° C.) so that the outer surface of the particles 13 is sufficiently softened. As is shown in FIG. 4, the belts 41 and 42 converge so that increasing pressure is exerted on the particles 13 between the belts 41 and 42 as the particles move from left to right in FIG. 4. In a final stage before the sheet material 10 exits from between the belts 41 and 42, the material 10 is subjected to a pressure of approximately 2000–3000 psi between the belts 41 and 42. Although the speeds at which the sheet material 10 can be produced may vary, in a preferred process, the sheet material 10 having dimensions suitable for manufacturing snowboard of other gliding board bases is produced at a rate of approximately 180 cm/min.

Figure 5:
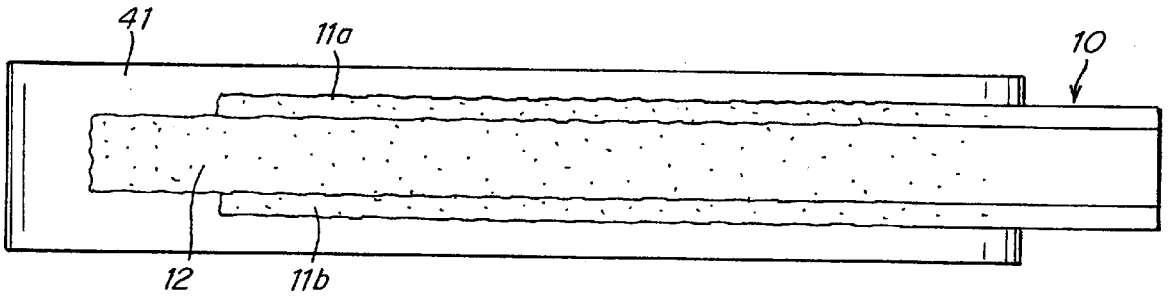
FIG. 5 is a cross-sectional view of the FIG. 4 apparatus along the line A—A in FIG. 4.

The particle feed devices 43 and 44 may deposit particles 13 on the belt 41 in any suitable pattern or patterns and may operate in any suitable way to do so. FIG. 5 shows an illustrative pattern used to form a sheet material 10 that can in turn be used to produce the snowboard base shown in FIG. 1. In this illustrative embodiment, the particle feed device 43 deposits particles 13 in an area 12 on the belt 41, and the particle feed device 44 deposits particles 13 in strips 11*a* and 11*b* on either side of the area 12. The result is that the particles in the strips 11 are joined together and to the particles in the central area 12 to form the final sheet material 10.

It should be understood that although the illustrative embodiment shown in FIG. 4 includes two particle feed devices 43 and 44, three or more feed devices may be used in different applications. Moreover, the particle feed devices 43 and 44 may operate in any suitable way as is well known in the art. For example, the particle feed device 43 and 44 may include a hopper arrangement that deposits particles 13 onto a sloped, vibrating tray (not shown). Particles 13 may slide off the tray and be directed between one or more fences (not shown) to certain areas on the belt 41. For example, the fences may be arranged so that particles 13 from the particle feed device 43 are directed to the area 12 on the belt 41, and particles 13 from the particle feed device 44 are directed to the areas 11*a* and 11*b* on the belt 41. While the fences may be arranged to define the area on the belt 41 in which the particles 13 are positioned, a doctor blade or other device may ensure that the particles 13 are deposited in a uniform and desired thickness on the belt 41.

The fences may be movable, e.g., in a direction parallel to the plane of the belt 41, to allow the width of the areas 11 and 12 on the belt 41 to be adjusted. For example, the fences may adjust the width of the area 12 to be wider in some portions of the sheet material 10 than in others. This ability to adjust the width of the areas 11 and 12 may be useful, for example, when forming a sheet material 10 for snowboards or other gliding boards that have a sidecut, or curvature of the edges 15 so that the base has a kind of hourglass shape as shown in FIG. 1. Thus, the area 12 may be made to have a corresponding hourglass-type shape in the sheet material 10 so that the areas 11*a* and 11*b* on the snowboard base are not made significantly more narrow near the center of the board as compared to the ends of the board, e.g., the areas 11*a* and 11*b* may have a substantially constant width along the length of the board shown in FIG. 1. The fences may ensure that the transition between areas 11*a*, 11*b* and 12 in the final sheet material 10 are relatively sharply defined by directing particles 13 for the areas 11 and 12 to form sharp boundaries before sintering. Alternately, the fences may allow more mixing of the particles 13 between areas 11 and 12 to fuzz the transition between areas.

In another illustrative embodiment, the particle feed devices 43 and 44 may have one or more controllable nozzles, gates, fences, or other devices so that particles 13 are placed on the belt 41 through the nozzles, etc. only in certain defined regions. Thus, the particle feed devices 43 and 44 may operate similarly (at least conceptually) to conventional ink jet printing heads, in which different inks are deposited in different areas of a printed page. This capability may allow the apparatus 40 to form any desired patterns of particles 13, such as text, graphics, geometric shapes, etc.

The particles 13 used to form the different areas of the sheet material 10 may themselves include additives or other substances to make the different areas of the sheet material 10 have different characteristics. For example, a plastic material having the desired characteristics for an area of the sheet material 10 may be ground or otherwise used to form particles 13 that are used to make the sheet material 10. As one example, a green plastic material may be ground to form green particles 13 that give corresponding areas of the sintered sheet material 10 a green color. Alternately, materials may be mixed in with the particles 13 so that the different areas of the sheet material 10 have different characteristics. For example, different coloring materials may be mixed with clear or translucent particles 13 that are formed by a precipitation process so that after sintering, the different areas of the sheet material 10 exhibit different colors. As mentioned above, any number of different materials may be added to form the different areas of the sheet material 10 so that the areas exhibit any suitable set of characteristics. Although the examples specifically provided above relate to different colored areas formed in a sheet material 10, it should be understood that the principles regarding how different characteristics may be incorporated into areas of the sheet material 10 may be extended to any suitable characteristics, such as hardness, lubricity, wear-resistance, etc.

While the invention has been described in conjunction with specific embodiments, many alternatives, modifications and variations will be apparent to those skilled in the art. Accordingly, embodiments as set forth herein are intended to be illustrative of the various aspects of the invention, not limiting. Various changes may be made without departing from the scope and sprit of the invention.

What is claimed is:

1. A sheet material suitable for forming gliding board bases, comprising:

a first area with a first set of characteristics formed from a first group of materials including plastic particles; and a second area with a second set of characteristics different from the first set of characteristics formed from a second group of materials including plastic particles;

wherein the first and second groups of materials are deposited on a support surface in respective first and second patterns while the support surface moves, and the plastic particles in the first and second groups of materials are sintered together to form a sheet on the support surface by a continuous sintering process.

2. A gliding board having a base that is formed using the sheet material of claim 1.

3. The material of claim 1, wherein the first and second sets of characteristics include wear-resistance and the first area is more wear-resistant than the second area of the sheet material.

4. The material of claim 1, wherein the first and second sets of characteristics include at least one of color and hardness, and the first area has one of a different color than the second area, and a higher hardness than the second area.

5. The material of claim 1, wherein the first and second areas together form one of a graphic, a text character, and an aesthetic design.

6. The material of claim 1, wherein the first area provides a faster gliding surface than the second area.

7. The material of claim 1, wherein the first and second groups include mixtures of different materials.

8. The material of claim 1, wherein the first and second groups include non-plastic materials.

9. The material of claim 1, wherein shapes of the first and second areas in the sheet closely match respective shapes of the first and second patterns of the first and second groups of materials before sintering.

10. The material of claim 1, wherein the first area has the first set of characteristics and the second area has the second set of characteristics different from the first set of characteristics immediately after sintering without any other process being performed.

11. The material of claim 1, wherein shapes of the first and second patterns on the surface before the plastic particles are sintered are substantially unchanged by sintering the plastic particles.

12. A sheet material suitable for forming gliding board bases, comprising:

a sheet including at least one of a text character, a geometric shape, and a graphic design formed from different groups of materials including plastic particles, the different groups of materials being deposited in respective patterns onto a moving support surface to form the at least one of a text character, a geometric shape, and a graphic design, the plastic particles in the different groups of materials being sintered after deposition onto the moving support surface to form the sheet.

13. The sheet material of claim 12, wherein the sheet includes a text character.

14. The sheet material of claim 12, wherein the sheet includes a geometric shape.

15. The sheet material of claim 12, wherein the sheet includes a graphic design.

16. The sheet material of claim 12, wherein the sheet material is formed by sintering alone to have a thickness suitable for incorporation in a gliding board without substantial alteration of the thickness.

17. The sheet material of claim 12, wherein the sheet material is formed by sintering alone to have a thickness of approximately 1.2 mm.

18. The sheet material of claim 12, wherein the sheet material is formed by sintering alone to have a thickness of less than approximately 5 mm.

19. The sheet material of claim 12, wherein the sheet material is formed by a continuous sintering process.

20. The material of claim 12, wherein the patterns into which the different groups of materials are deposited have shapes before sintering that approximately form the at least one of a text character, a geometric shape, and a graphic design.

21. The material of claim 12, wherein the at least one of a text character, a geometric shape, and a graphic design is formed in the sintered sheet after sintering the different groups of materials without any other process being required.

22. The material of claim 12, wherein shapes of the patterns of the different groups of materials on the moving surface before sintering are substantially unchanged by sintering the plastic particles.

* * * * *